US008966830B2

(12) United States Patent
Trenkler

(10) Patent No.: US 8,966,830 B2
(45) Date of Patent: Mar. 3, 2015

(54) SAFETY DEVICE

(75) Inventor: Johann Trenkler, Niederschönenfeld (DE)

(73) Assignee: Südzucker Aktiengesellschaft Mannheim/Ochsenfurt, Mannheim (DE)

( * ) Notice: Subject to any disclaimer, the term of this patent is extended or adjusted under 35 U.S.C. 154(b) by 0 days.

(21) Appl. No.: 13/983,634

(22) PCT Filed: Feb. 10, 2012

(86) PCT No.: PCT/EP2012/000607
§ 371 (c)(1),
(2), (4) Date: Aug. 5, 2013

(87) PCT Pub. No.: WO2012/107234
PCT Pub. Date: Aug. 16, 2012

(65) Prior Publication Data

US 2013/0312918 A1 Nov. 28, 2013

(30) Foreign Application Priority Data

Feb. 11, 2011 (DE) ..... 10 2011 010 928

(51) Int. Cl.

| | |
|---|---|
| ***E04B 1/346*** | (2006.01) |
| ***E04B 7/16*** | (2006.01) |
| ***E04B 2/74*** | (2006.01) |
| ***A62B 33/00*** | (2006.01) |
| ***E04H 17/16*** | (2006.01) |

(Continued)

(52) U.S. Cl.
CPC ..... *E04B 2/7401* (2013.01); *A62B 33/00* (2013.01); *E04B 2/7405* (2013.01); *E04H 17/16* (2013.01); *E05D 1/04* (2013.01); *E05D 7/009* (2013.01)
USPC ..... 52/67; 52/65; 52/71; 52/291; 405/71; 405/279

(58) Field of Classification Search
CPC ..... E04B 2/7401; E04B 2/7405; E04H 17/16; E05D 1/04; E05D 7/009; E06B 9/15; E06B 2009/1544; E06B 9/165; A62B 33/00
USPC ..... 52/64, 65, 67, 71, 222, 291; 405/71, 405/279
See application file for complete search history.

(56) References Cited

U.S. PATENT DOCUMENTS

| | | | | |
|---|---|---|---|---|
| 859,295 | A * | 7/1907 | Hill | 405/281 |
| 1,357,819 | A * | 11/1920 | Peele | 160/232 |
| 2,861,277 | A * | 11/1958 | Hermann | 220/642 |

(Continued)

FOREIGN PATENT DOCUMENTS

| | | | |
|---|---|---|---|
| FR | 1168722 | A | 12/1958 |
| FR | 2173835 | A1 | 10/1973 |

OTHER PUBLICATIONS

Translation of FR1168722 provided by espacenet.*

(Continued)

*Primary Examiner* — Brian Glessner
*Assistant Examiner* — Brian D Mattei
(74) *Attorney, Agent, or Firm* — Bateman IP

(57) ABSTRACT

The present invention relates to a device for the protection of living beings and objects from being buried in bulk material, a method for assembling said device and uses employing this device.

14 Claims, 8 Drawing Sheets

(51) Int. Cl.
*E05D 1/04* (2006.01)
*E05D 7/00* (2006.01)

(56) References Cited

U.S. PATENT DOCUMENTS 4,033,137 A * 7/1977 Geist ..... 405/71
4,125,394 A * 11/1978 Wilson ..... 71/9
6,041,847 A * 3/2000 Lai ..... 160/236
6,062,342 A 5/2000 Dobson
7,175,369 B2 * 2/2007 Fomenkov et al. ..... 405/281
2004/0149401 A1 * 8/2004 Rinkewich ..... 160/235

OTHER PUBLICATIONS

International Preliminary Report on Patentability, including Written Opinion of the International Searching Authority, Aug. 22, 2013.

* cited by examiner

SAFETY DEVICE

FIELD OF INVENTION

The present invention relates to a device for the protection of living beings and objects from being buried in bulk material, a method for assembling said device and uses employing this device.

BACKGROUND

Bulk material in waste dumps, silos, portioning hoppers or other storage facilities is used for many different commercial and industrial applications, including the food, chemical, catalyst, raw material and construction material sectors. Such bulk material can accordingly be found in the form of sugar, cereal, rice, flour, granulates, extrudates, sand, gravel or similar materials.

Although such material is not liquid and often gives the impression of being stable and firm, very often it is free-flowing and pourable, thus presenting a movable and unpredictable mass that might bury living beings, in particular humans, as well as objects. In fact, persons working with bulk material are time and again buried under such material and die as a result. They might either sink into the bulk material and/or be buried by an afterflow of bulk material. This is aggravated by the fact that it is not always the entire bulk material in the silo that starts to move in the form of a mass flow, but only a spatially limited part of the bulk material might move (core flow). These dangers may increase due to the formation of bridges and shafts or of bonded or wedged bulk material and the formation of frost funnels or spaces within the bulk material. Persons or larger objects that have sunk into the bulk material usually cannot be pulled out again due to the considerable mass of the bulk material and its potential suction effect, even if they have not yet been completely pulled in. There are frequent reports of desperate attempts to protect persons from being buried by the afterflow of bulk material, which usually involve provisional auxiliary constructs of panels, planks, metal sheets or similar material in order to try to keep the afterflow of bulk material away from the victim. Unfortunately such improvised aids do not always serve their purpose. Often they are not stable enough, cannot be handled correctly under stress or do not allow the necessary adjustments to the spatial conditions of the accident. On the one hand, protective constructions must fit through bulk material containers with often narrow openings, and on the other hand, they must be spatially flexible enough to protect a potentially extensive area from burial, e.g. they must protect a lying, trapped person. A protective device must further be robust and safe, but also reliably manageable under massive stress to provide the protective effect as required in any individual emergency situation.

SUMMARY

The present invention relates to a device for protecting living beings and objects from being buried, characterized in that it comprises at least two wall elements interconnected by means of a trunnion joint, both of which feature a rectangular basis with a first pivot bolt edge in the form of a circular thickening and a second hinged rail edge in the form of a circular segment holder opposing the first edge, and wherein two of the wall elements are each interconnected by means of the trunnion joint formed by the first and second edges of adjacent wall elements in rear grip in such a manner that the wall elements are vertically slideable and horizontally rotatable up to an angle of 60° minimum.

In some embodiments, the circular segment holder features a gap along the entire length of the second edge. In some embodiments, the gap is of an angle of 80° to 150°. In other embodiments, the wall elements are constructed of metal or plastic. In yet other embodiments, the wall elements are identical. In some embodiments, the device contains four, five or six wall elements. In some embodiments, the wall elements form a tube or a wall.

In another aspect, the present invention further provides a device, wherein at least two of the wall elements are connected to at least one telescopic pole by means of a trunnion joint in such a manner that the at least two wall elements are vertically slideable and horizontally rotatable towards the at least one telescopic pole and each other. In some embodiments, the telescopic pole features a circular segment holder and a circular thickening on its ends.

In yet another aspect, the present invention provides a wall element with a first and an opposing second edge, wherein the first edge is designed as a circular thickening and the second edge as a circular segment holder with a gap extending along the entire length of the second edge. In some embodiments, the circular segment holder forms an open tube featuring a gap. In other embodiments, the circular thickening is realized as a tube.

In yet another aspect, the present invention provides a method for assembling a device as described above, comprising connecting two or more wall elements, wherein each wall element has a first and an opposing second edge, wherein the first edge is designed as a circular thickening and the second edge as a circular segment holder with a gap extending along the entire length of the second edge, by sliding a pivot bolt edge of a wall element through the open end of a hinged rail edge of another wall element along the longitudinal axis of said hinged rail edge into the latter and by thus reversibly connecting the two wall elements in a vertically and horizontally slideable manner, wherein preferably one or more further wall elements are added by repeating the previously described procedural step.

In some embodiments of the method described above, at least one telescopic pole is reversibly connected in a vertically and horizontally slideable manner to at least two wall elements. In other embodiments, the method comprises a first procedural step a) at least two wall elements as described above are provided, in a second procedural step b) the at least two wall elements are interconnected in such a manner that they are vertically slideable and horizontally rotatable towards each other, and in a third procedural step c) the at least two interconnected wall elements are placed between the bulk material and the living beings or objects.

In some embodiments, the at least two wall elements are interconnected in such a manner that they are vertically slideable and horizontally rotatable by means of a telescopic pole in another procedural step.

DETAILED DESCRIPTION

The present invention provides a device for the protection of living beings, in particular humans, but also of objects, from burial under bulk material that is able to overcome the drawbacks described above and is especially apt to ensure a safe, reliable, easy to handle, quickly deployable, robust and spatially flexible protection from accidental burial.

The present invention further provides a method for assembling such a device that meets these requirements, as well as a method for the prevention of accidental burial of living beings and objects.

The present invention further provides a device for the protection of living beings and objects from accidental burial in bulk material which contains at least two wall elements connected by means of a trunnion joint, in particular a trunnion joint with two degrees of freedom, wherein the wall elements are identical in the preferred embodiment and wherein each wall element features a rectangular, preferably planar basis with one edge implemented in the form of a circular thickening and a second edge implemented in the form of a circular segment holder facing the first edge, and wherein two of the wall elements are connected via the trunnion joint formed by the telescoped first and second edges with rear grip of adjacent wall elements in such a way that the wall elements can be slid vertically towards one another and rotated towards one another to an angle of at least 60°.

According to one aspect of the present invention, the inventive device is assembled by sliding the first edge of a first wall element into the terminal opening of a holder formed by the second edge of a second wall element along the longitudinal axis of the second edge, which provides for a device with a trunnion joint and at least two wall elements according to the present invention. Further wall elements can be added to the device assembled in this manner. According to the invention, the edge of the pivot bolt of a first wall element may slide into the circular segment holder of a second wall element from above or below (that is, from the end of either of the two edges of the second edge and along its longitudinal axis), to form a trunnion joint connecting both wall elements and thus form a modular system of wall elements by adding further wall elements as described.

The inventive device is thus characterized by at least two wall elements articulately connected to one another, which are interconnected by a trunnion joint that is formed by their two adjoining edges. The wall elements forming the inventive device are identical in the embodiment and characterized by their rectangular, possibly also square, base form. A first edge of this wall element presents a—viewed in cross section—circular thickening, which preferably leads across the entire length of the edge of the wall element and which is also identified as pivot bolt edge in the present document. The pivot bolt edge may therefore comprise a rotary cylinder or straight circular cylinder immediately adjacent to the rectangular, preferably planar, basis of the wall element. In another embodiment, it may also be a straight hollow cylinder. In another embodiment of the present invention, the central axis of this circular or hollow cylinder lies in a plane that is determined by the planar surface area of the basis. In another embodiment, the central axis of the circular or hollow cylinder does not lie within a plane with the plane determined by the planar surface area of the basis, but in a parallel plane. In particular, the central axis lies in an angle of preferably 1 to 179°, alternatively 30 to 170°, alternatively 40 to 160°, alternatively 50 to 150°, alternatively 60 to 30°, alternatively 90° to the plane of the basis. The opposing edge of that same wall element, which is denominated "the second edge" of the wall element, is implemented as a (in the cross section) circular segment holder, also denominated "hinged rail edge" in this context, alternatively also along the entire length of the second edge. The circular segment holder is formed by two semicircular sides attached to the basis of the wall element, which (in the cross section) partially enclose a semicircular cavity and thus form a rail that is capable of telescoping along the longitudinal axis and therefore of accepting the pivot bolt edge (with smaller cross section) of another wall element. The semicircular holder features a gap, preferably across the entire length of the second edge, through which the basis of the telescoped wall element penetrates. As the width of the gap is greater than the thickness of the penetrating basis of the telescoped wall element—optionally 2, 3 or 4 times as wide—the latter can be rotated horizontally. In another embodiment, the width of the gap may amount to 0.5 to 7 cm, 1 to 6 cm, 1 to 4 cm, in particular 2 to 2.9 cm, in particular 2.5 to 2.9 cm.

In one embodiment, the geometrical center of the gap does not lie in the same plane as the basis. In another embodiment of the present invention, the geometrical center of the gap lies at an angle of 70 to 170°, 80 to 160°, 85 to 150°, or 120° to the basis of the wall element. The diameter of the circular thickening (in its cross section) of the first edge and the circular segment holder of the second edge are aligned in such a way that the circular thickening presents a diameter that is smaller than the inner diameter of the circular segment holder—for instance by a factor of 0.05, 0.1 or 0.15. In one embodiment, the diameter of the circular thickening may be 0.9 to 4.5 cm, 1.8 to 4.0 cm, 2.5 to 3.5 cm, or 3 cm. The gap is wider than the basis of the wall element is thick, but smaller than the diameter of the pivot bolt edge. The span width of the gap formed by the second edge of the circular segment holder is also designed in such a manner that the circular thickening of the first edge, i.e. the pivot bolt edge, cannot be horizontally extracted from it. The pivot joint edge of a wall element introduced into the hinged rail edge of another wall element thus provide a rear grip according to the invention. Accordingly, the connection or separation of the (at least) two wall elements can only be accomplished by telescoping or pulling out the wall elements through an opening at the end of the hinged rail edge along its first and second edges. According to the invention, this is accomplished by the fact that the circular segment holder is open either a) on the top or b) on the bottom or c) on the tip and the bottom of at least one of the ends of its edge. As according to the invention, the hinged rail edges are open a) on the top or b) on the bottom or c) on the top and the bottom, that is, on both ends of the second edge, and the diameters of the circular segment holder and the circular thickening are furthermore designed in such a way that they allow for much clearance, the wall elements can be prevented from getting stuck during their handling within the bulk material.

The device features at least two wall elements that are connected by a trunnion joint formed by the circular thickening and the circular segment holder partially enveloping it and thus provides a high degree of geometrical and surface flexibility. If, for instance, only two wall elements are connected, they can be applied in the form of a modular wall, the modules of which, i.e. wall elements, can be rotated horizontally and moved vertically. In another embodiment of the present invention, the modular walls can also be comprised of three, four, five, six, seven, eight, nine, ten or more wall elements. In another embodiment, at least three, but preferably four, five, six, seven or more wall elements can be connected to one another in order to form a device according to the invention, wherein these wall elements form a tubular device and horizontally enclose a space in a tubular fashion. In this embodiment, the first and the last wall element of the device according to the invention are also connected through a trunnion joint. With this embodiment of the invention, a person or object can be horizontally enclosed on all sides and protected from bulk material. According to the invention, the embodiment also facilitates the siphoning of bulk material from an area protecting a person or object that is enclosed on all sides by the inventive device without the risk of constant afterflow. The device thus not only allows for a linear separation from the afterflow of bulk material, but also a circular protection of a person within a confined space.

In the case of a horizontal enclosure of a confined space by connecting the first and the last wall element by means of a trunnion joint, horizontal rotation of the wall elements toward one another is not possible or is possible only to a limited degree.

The wall elements offer the advantage of allowing horizontal counter-rotation even within the bulk material. The device further allows for adjustment to varying levels even within the bulk material due to its vertical flexibility, i.e. the vertical slideability of the wall elements against each other, and can thus be adapted to larger chunks within the bulk material, structural conditions, extended arms or trapped legs. The device, which allows for vertical slideability of the single wall elements towards one another as well as horizontal rotation of the wall elements towards one another, facilitates in an advantageous manner the protection of buried persons or objects within a confined space from bulk material. The embodiment of the invention might consider the insertion of further wall elements into an already provided inventive device, in particular during a rescue operation, in order to adapt to the conditions changing over time.

The device is characterized in that it can be of any surface area and/or geometry. The trunnion joint mechanism provided by the invention for instance also allows for devices that not only feature more than one wall element extending horizontally, but also vertically. In one embodiment, a hinged rail edge of a wall element can accommodate and fix two first edges, i.e. pivot joint edges, of two wall elements telescoped on top of each other. The hinged rail edges of the two telescoping wall elements may be connected to another two or three (or more) slideable and rotatable wall elements. In another embodiment, the single elements required for assembling such a protective device unlimited in its possibilities with regard to size and geometry are comparatively small and well manageable, however, as they are essentially rectangular wall elements that are easily stored on socket devices, pins or flat next to or on top of one another near the bulk material and therefore readily available.

In one particular embodiment, the gap of the holder features an angle of 80 to 150°, 90 to 145°, 90 to 120°, or 100°.

In another embodiment, the wall elements are constructed or metal of plastic, in particular are constructed or consist primarily thereof. In yet another embodiment, the wall elements are metal sheets, such as aluminum or steel sheets.

In another embodiment, the wall elements, in particular in the case of sheets, are 0.1 to 2 cm, 0.2 to 1.5 cm, 0.3 to 1 cm, 0.4 to 0.8 cm, or 0.5 to 0.6 cm thick. In a particular embodiment, the basis of the wall element is rectangular and particularly features two short and two long edges, wherein the long edges form the first and the second edges, which form the circular thickening and the circular segment holder, respectively. In another embodiment, the wall elements present a form with short edges and a length of 20 to 70 cm, 30 to 65 cm, 35 to 60 cm, 35 to 50 cm, or 37 to 38 cm. In another embodiment, the wall elements present a form with a first and a second edge with a length of 60 to 140 cm, 70 to 130 cm, 80 to 120 cm, 90 to 110 cm, or 100 cm.

In yet another embodiment, each wall element features a first edge in the form of a tube, such as in the form of a hollow tube, and a holder in the form of a circular segment, such as a C-holder or a holder in the form of a three-quarter circular segment, for instance in the form of a slotted hollow tube, on the opposite side.

In another embodiment, the opening width of the gap of the circular segment holder is designed in such a way that the inserted wall element can be rotated in an angle of 90 to 145°, or alternatively 95 to 140°.

An alternative embodiment provides for a device according to the present invention forming a pentagonal tube consisting of five wall elements (viewed in cross section). In another embodiment, the device consists of six wall elements forming a hexagonal tube (viewed in cross section).

In another embodiment, the present invention also provides a device consisting of at least two wall elements in the form described above, wherein the device additionally features a telescopic pole adjustable in length. A telescopic pole of this type may, depending on the rescue operation performed, serve to stabilize the wall elements or device through connection to at least two of the wall elements of the inventive device, for instance by attaching it onto the wall elements or by replacing one or several wall elements therewith.

In another embodiment, the present invention therefore also relates to a device, in particular to the type described above, wherein said device comprises at least two wall elements connected by means of a trunnion joint, and wherein two of the wall elements are connected through at least one trunnion joint each with at least one telescopic pole in such a manner that the (at least) two wall elements are vertically slideable and horizontally rotatable towards one another with an angle of at least 60°.

According to the invention, this embodiment also provides that the telescopic pole connect at least two wall elements of the inventive device in such a manner that they are vertically slideable and horizontally rotatable towards one another, with the connection preferably being reversible. The telescopic pole used according to the invention preferably features a holder in circular segment form at either end as well as a circular thickening (both viewed in cross section). In another embodiment, the telescopic pole features a holder in circular segment form at one end, which is suitable for accepting the circular thickening (viewed in cross section) of the pivot bolt edge of a wall element. The other end of the telescopic pole features a circular thickening (viewed in cross section) in another embodiment, which can be inserted into the hinged rail edge forming a holder in circular segment form of a wall element according to the invention. A telescopic pole according to the invention can therefore be connected to the wall elements of the present invention in such a manner that the edge of the first wall element forms a first trunnion joint and the edge of the second wall element forms a second trunnion joint, thus rendering the wall element(s) vertically slideable and horizontally rotatable towards the telescopic pole.

In another embodiment, the present invention also provides a wall element which is an essential, in particular the only component of the inventive device. In one particular embodiment, such a wall element features a first and an opposing second edge, wherein the first edge is designed as a circular thickening and the second edge as a holder in circular segment form with a gap extending along the entire length of the second edge. In another embodiment, the circular segment holder is designed as a tube with a longitudinal gap. In another embodiment, the circular thickening is designed as a tube.

In another embodiment, the present invention also provides a method for assembling a device according the invention, wherein wall elements according to the present invention are interconnected by sliding a pivot bolt edge of a wall element through the open end of a hinged rail edge of another wall element along the longitudinal axis of said hinged rail edge into the latter, thus reversibly interconnecting the two wall elements in a vertically and horizontally slideable manner and adding and connecting at least one further wall element by repeating the previously described procedural step, if required.

In yet another embodiment, the present invention provides a method wherein at least one telescopic pole is reversibly connected to at least two wall elements in a vertically and horizontally flexible manner, such as by forming a first trunnion joint with a first wall element and a second trunnion joint with a second wall element.

The present invention also provides a method for the protection of a living being or object from being buried in bulk material, wherein a first procedural step a) provides at least two wall elements according to the present invention, a second procedural step b) provides at least two wall elements, for example, three, four, five, six, seven or eight wall elements which are interconnected to form an inventive device, whereby the connection is for example vertically slideable and horizontally rotatable, such as by forming trunnion joints between two wall elements, and a third procedural step c) provides a device according to the present invention, having at least two interconnected wall elements, which are placed between the bulk material and the living beings or objects.

In another embodiment, the present invention also provides a method to protect living beings or objects from being buried in bulk material of the previously described type, wherein in another procedural step the at least two wall elements are connected in a vertically slideable and horizontally rotatable manner by means of a telescopic pole.

The present invention also relates to the use of a wall element according to the present invention or a device according to the present invention to protect living beings or objects from being buried in bulk material.

The subclaims provide further advantageous embodiments of the present invention.

The present invention is described in more detail in the following examples and the corresponding figures without limiting the scope of protection.

The figures show the following:

EXAMPLE

Figure 1:
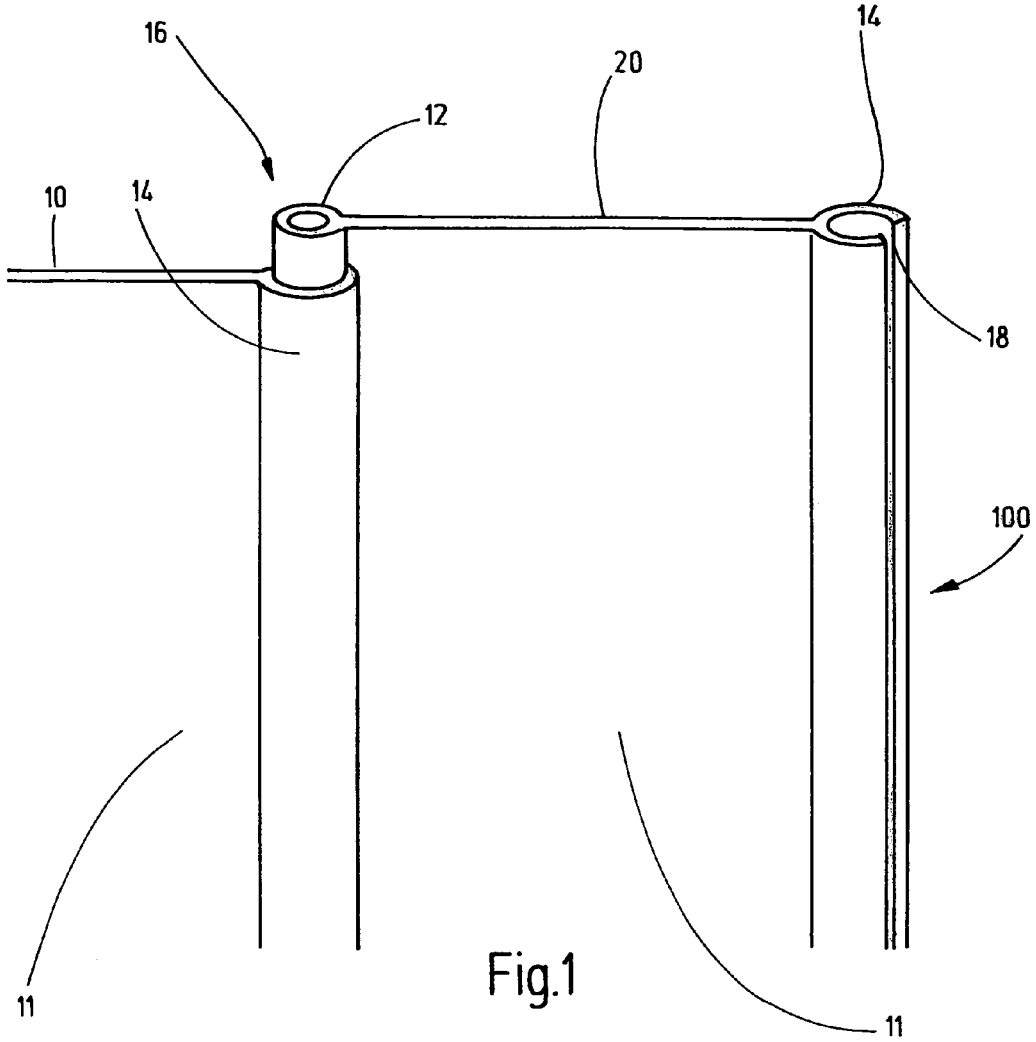
FIG. 1 shows a perspective view of an inventive device.
Figure 2:
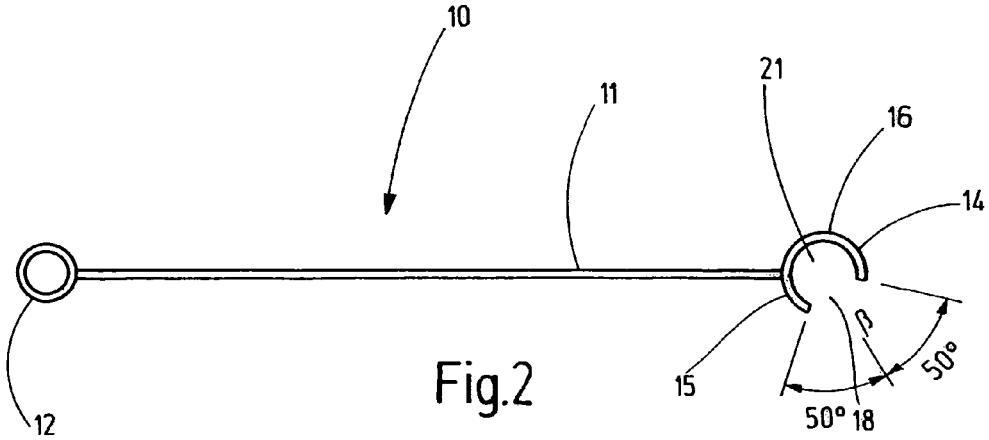
FIG. 2 shows the cross section of a wall element according to the invention.

FIG. 1 shows a device 100 according to the invention, which has been assembled by joining two identical first and second wall elements 10, 20. FIG. 2 shows the cross section of a wall element 10. FIGS. 1 and 2 illustrate that the wall element 10 consists of an even, rectangular basis 11 with two opposing longitudinal edges 12, 14 that are differently designed. A first edge 12 of the wall element is (viewed in its cross section) implemented as a circular thickening 12—here as a tube connected to the basis 11 in one piece—and forms the so-called pivot joint edge. The opposing second edge is implemented in the form of a circular segment holder, i.e. hinged rail edge 14 and feature two semicircular sides 15, 16, which form an open hinged rail edge 14 on the top and the bottom, i.e. at the ends thereof. The inner diameter of the circular segment holder 14 exceeds the total diameter of the circular thickening, i.e. the pivot bolt edge 12 so that the pivot bolt edge 12 can be introduced into the hinged rail edge 14 along its longitudinal axis, starting at one of its open ends 21. The angle β of the gap 18 in the holder 14 has been adjusted such that a pivot bolt edge 12 that has been introduced into the circular segment holder 14 cannot be extracted, as its diameter exceeds the angle β of the gap 18. In this case, the angle is approx. 100°.

A device 100 according to the invention is formed by at least two such wall elements 10, 20, as can be seen in FIG. 1. As the first edge, i.e. the pivot bolt edge 12 of a wall element 10, is brought into rear grip with the second edge 14 of a second wall element 20, i.e. its hinged rail edge 14, by introducing it, the second edge, i.e. the hinged rail edge, of the first wall element 10 can accept a pivot bolt edge 12 of another wall element and so forth. In this manner, an infinite amount of wall elements can be interconnected.

Figure 3:
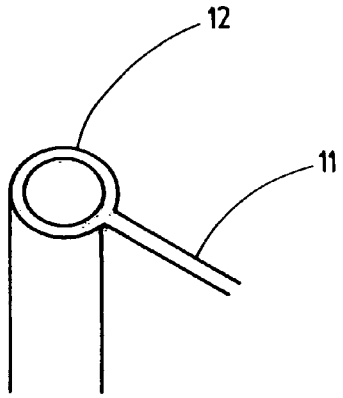
FIG. 3 shows a part of a wall element according to the invention in perspective view, namely the circular thickening of a first wall element.
Figure 4:
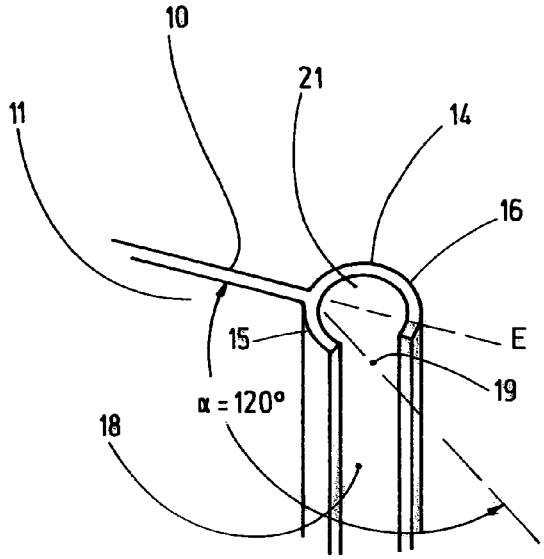
FIG. 4 shows another part of a wall element according to the invention in perspective view, namely the circular segment holder of a first wall element.
Figure 5:
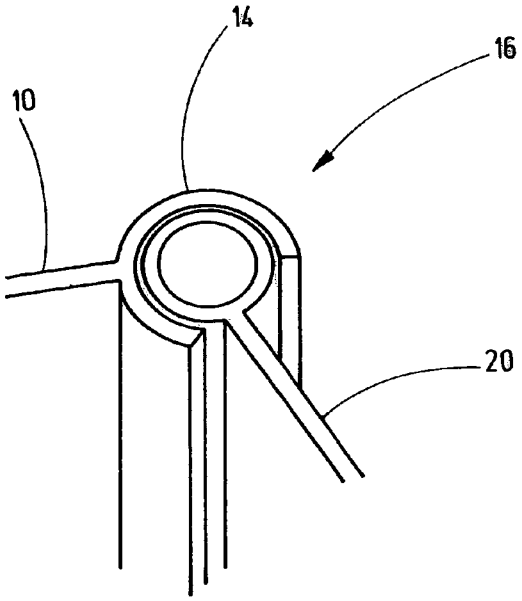
FIG. 5 shows a trunnion joint formed by introducing the circular thickening of a wall element into the circular segment holder of another wall element of an inventive device.

FIG. 3 shows a partial view of a basis 11 with its pivot bolt edge 12, which, due to its circular design (as viewed in cross section), allows for its introduction into a hinged rail edge 14 as shown in detail in FIG. 4 along its longitudinal axis, starting from the opening 21 at the end of the holder 14. FIG. 4 also shows that the geometrical center 19 of the gap 18, which is delimited by the two sides 15 and 16 of the holder 14, is not in the—supposedly—same plane E as the basis 11 of the wall element 10, but rather at an angle α of 70 to 170° to the latter—in this case 120°.

By introducing the pivot bolt edge 12 into the opening 21 at the end of the hinged rail edge 14, a trunnion joint 16 with two degrees of freedom, that is, a vertical and a horizontal degree of freedom, each of which allows for horizontal and vertical sliding, is formed, which provides much clearance due to the smaller diameter of the circular thickening 12 when compared to the inner diameter of the circular segment holder 14.

Figure 6:
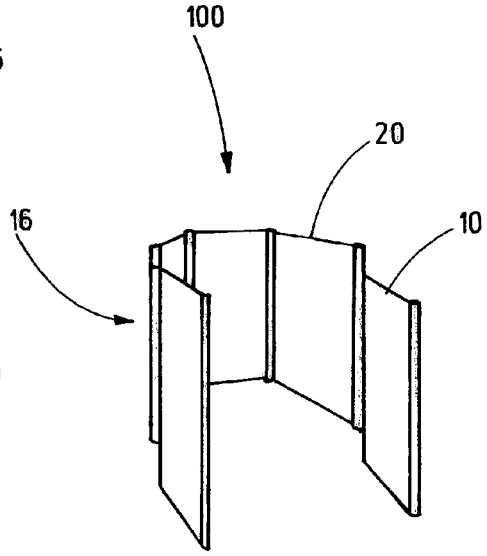
FIG. 6 shows an inventive device in the form of a modular wall.

FIG. 6 illustrates another embodiment of a device 100 according to the invention, wherein five wall elements 10, 20 are interconnected as a modular wall. The device can clearly be adjusted to varying horizontal spatial conditions due to the vertical slideability and horizontal rotatability of the wall elements 10, 20 towards one another.

Figure 7:
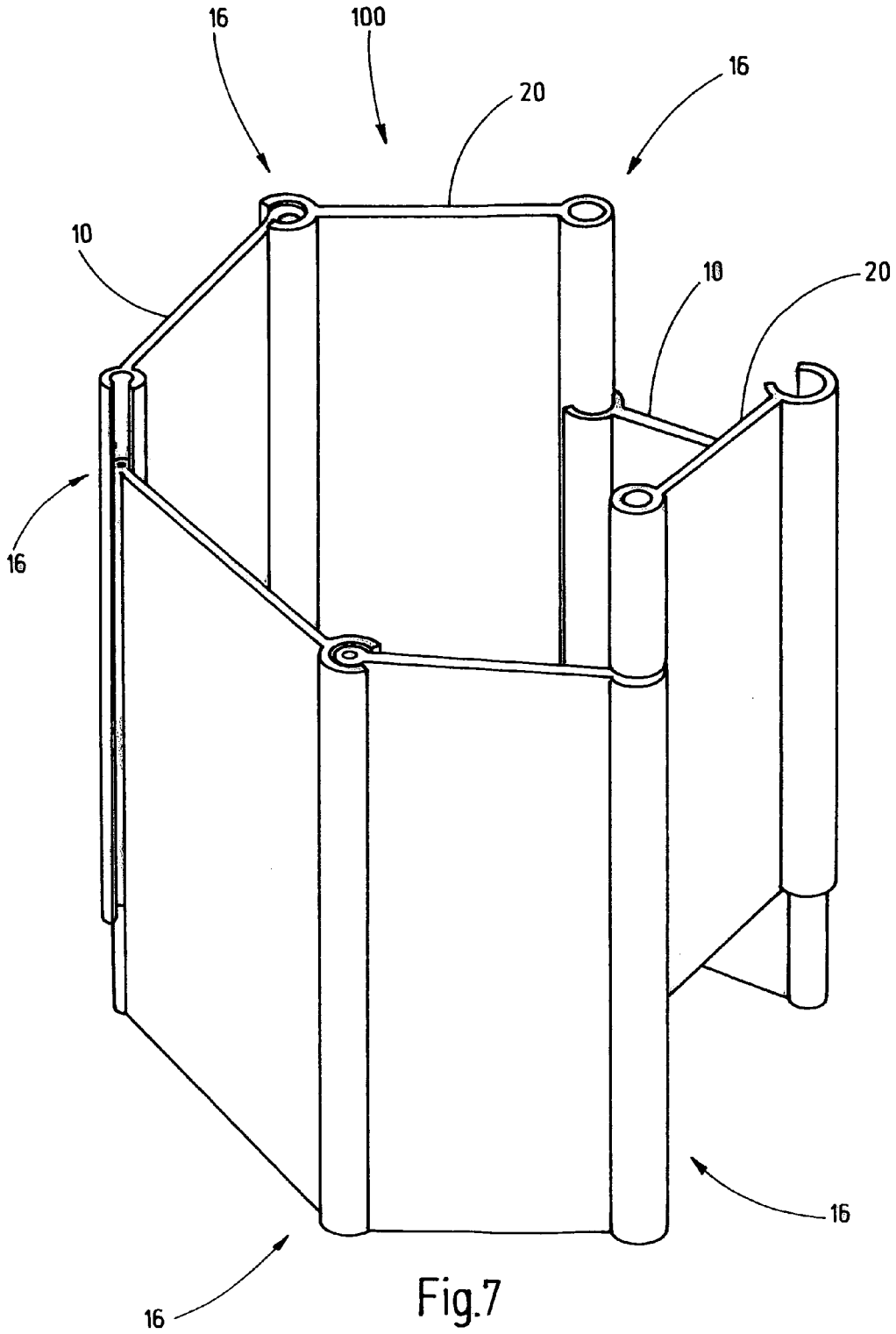
FIG. 7 shows an inventive device in the form of a hexagonal open tube.

FIG. 7 shows another embodiment of a device 100 according to the invention, in which six wall elements 10, 20 are interconnected via six trunnion joints 16 in the form of a hexagonal tube, thus providing a confined space for protection from being buried.

Figure 8:
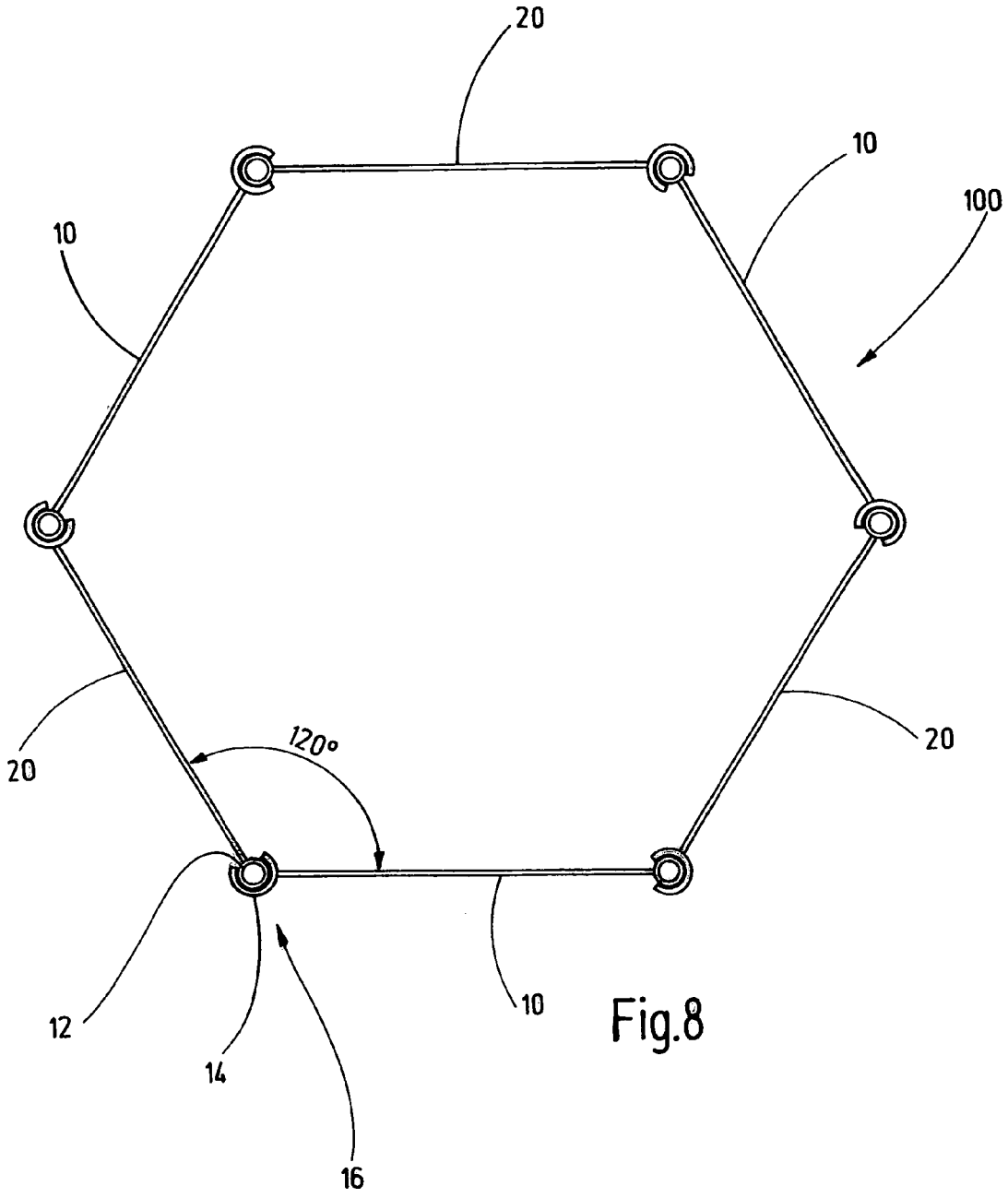
FIG. 8 shows the cross section of an inventive device in the form of a hexagonal tube.

FIG. 8 shows a device 100 according to the invention in cross section.

Figure 9:
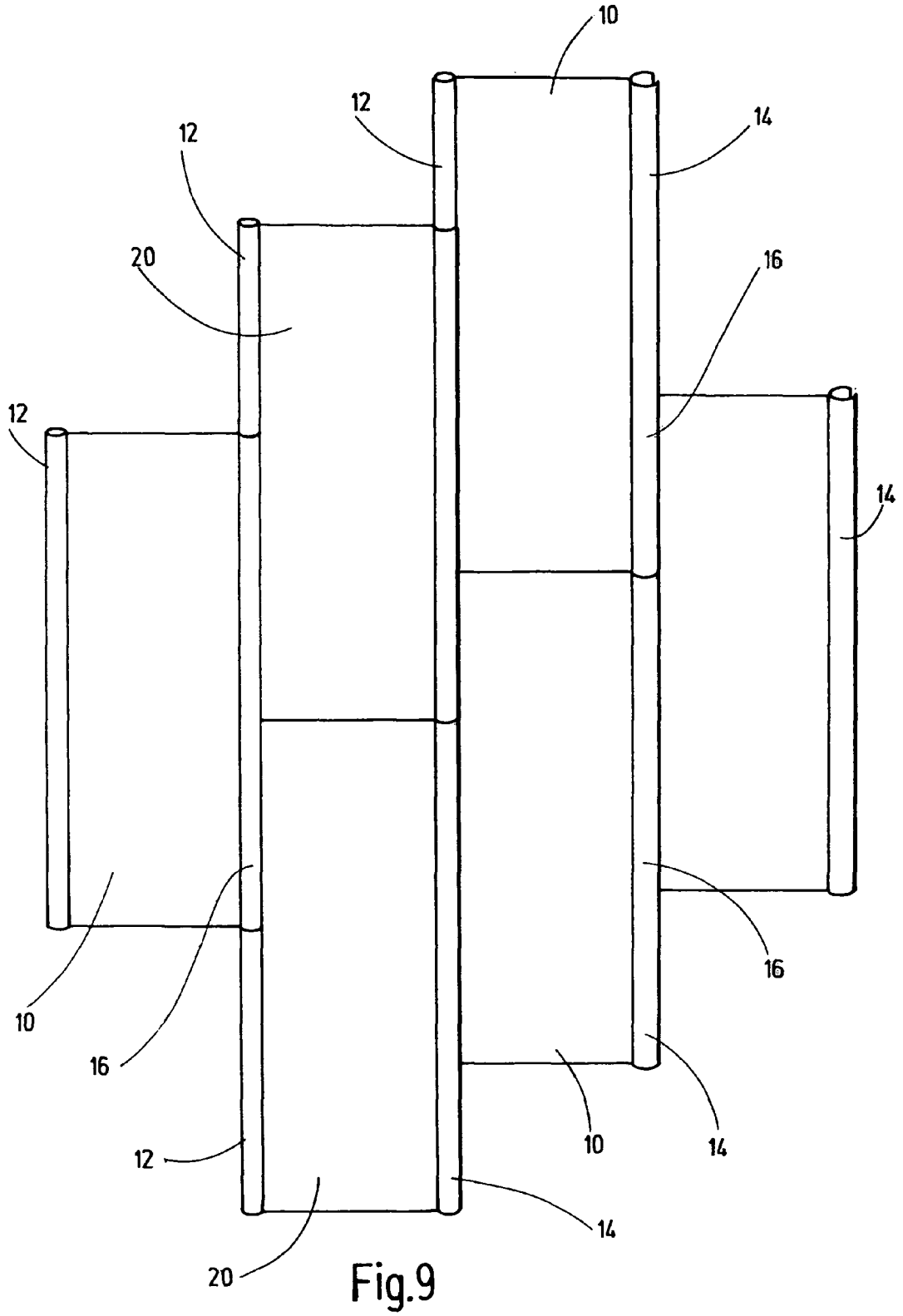
FIG. 9 shows another embodiment of an inventive device.

Further embodiments are possible, of course—such as those illustrated in FIG. 9 and according to which further wall elements 10, 20 are arranged vertically on top of one another.

Figure 10:
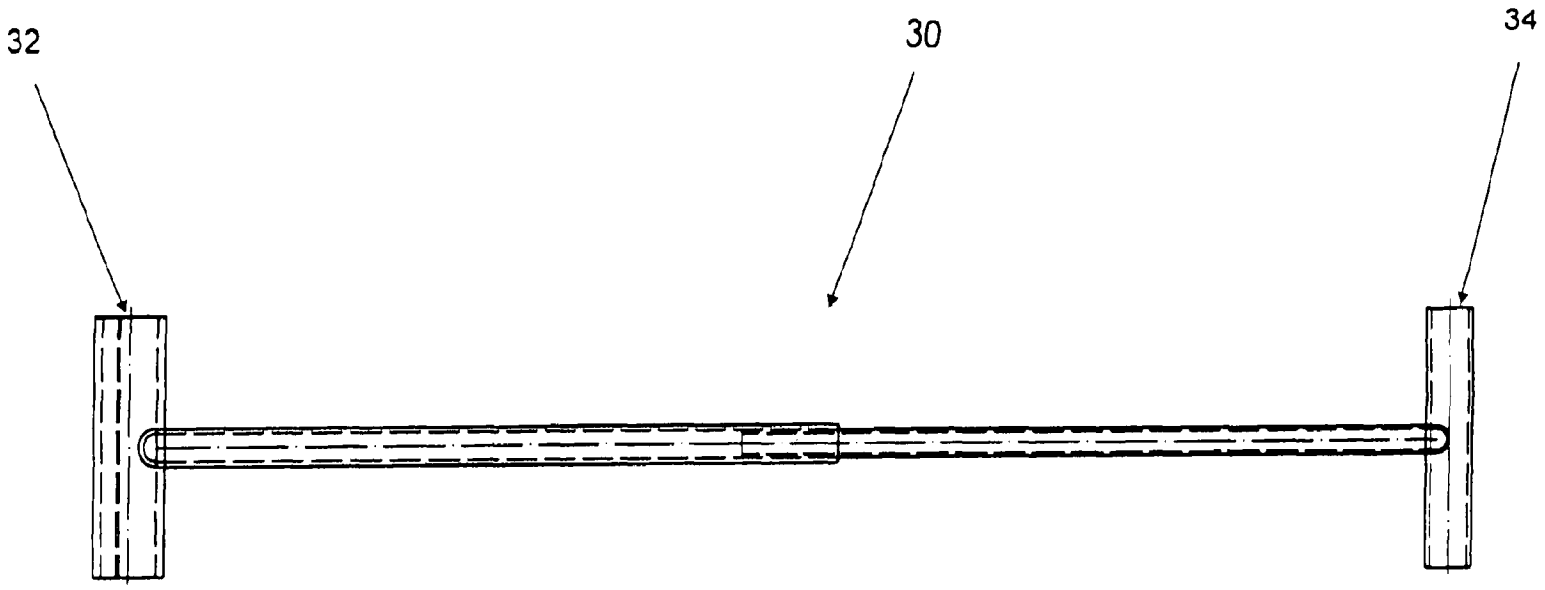
FIG. 10 shows a bird's-eye-view of the telescopic pole used according to the invention.

FIG. 10 shows a telescopic pole 30 employed according to the invention, which, if used according to the rescue operation, can serve as a spacer and replace at least one of the wall elements 10, 20 required in a device 100 according to the invention. The telescopic pole 30, which is adjustable in length, features a circular segment holder 32 (viewed in cross section) on one of its ends and a circular thickening 34 (viewed in cross section) on the opposite end. By means of these specially designed ends 32, 34, the telescopic pole 30 can form two trunnion joints 16 with the hinged rail edge 14 of a first wall element 10 forming a circular segment holder and the pivot bolt edge 12 of a second wall element 20 forming a circular thickening 12 and thus yield a vertically slideable and horizontally rotatable (up to an angle of 60° minimum) device.

Figure 11:
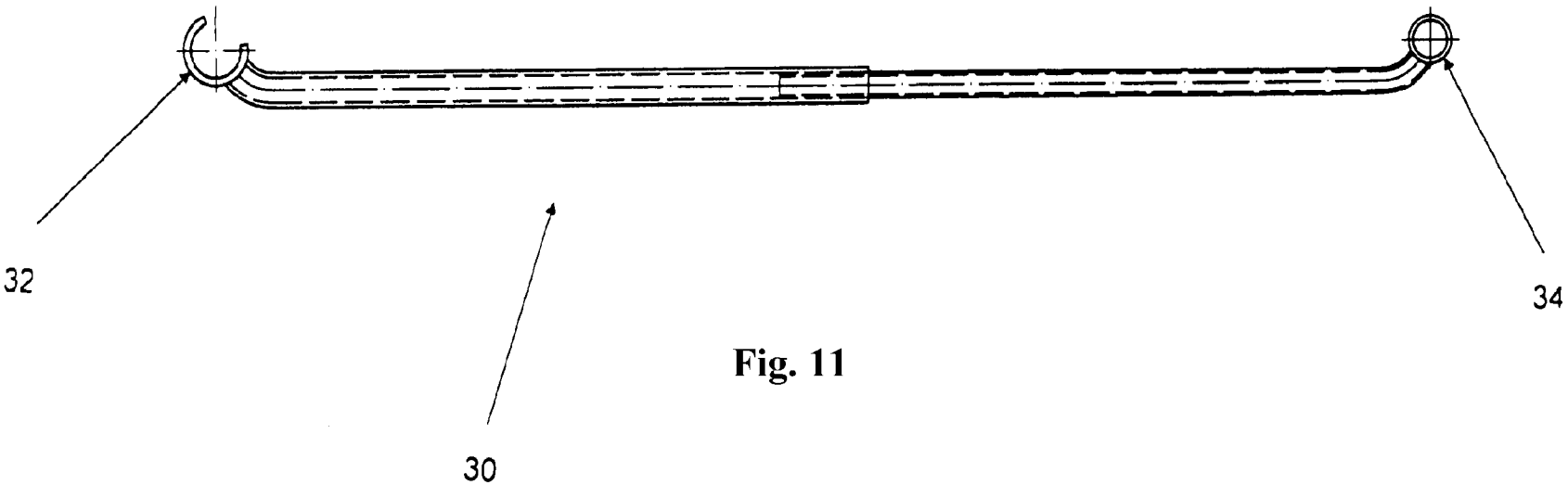
FIG. 11 shows a cross section of a telescopic pole used according to the invention.

FIG. 11 shows the cross section of the telescopic pole 30.

Figure 12:
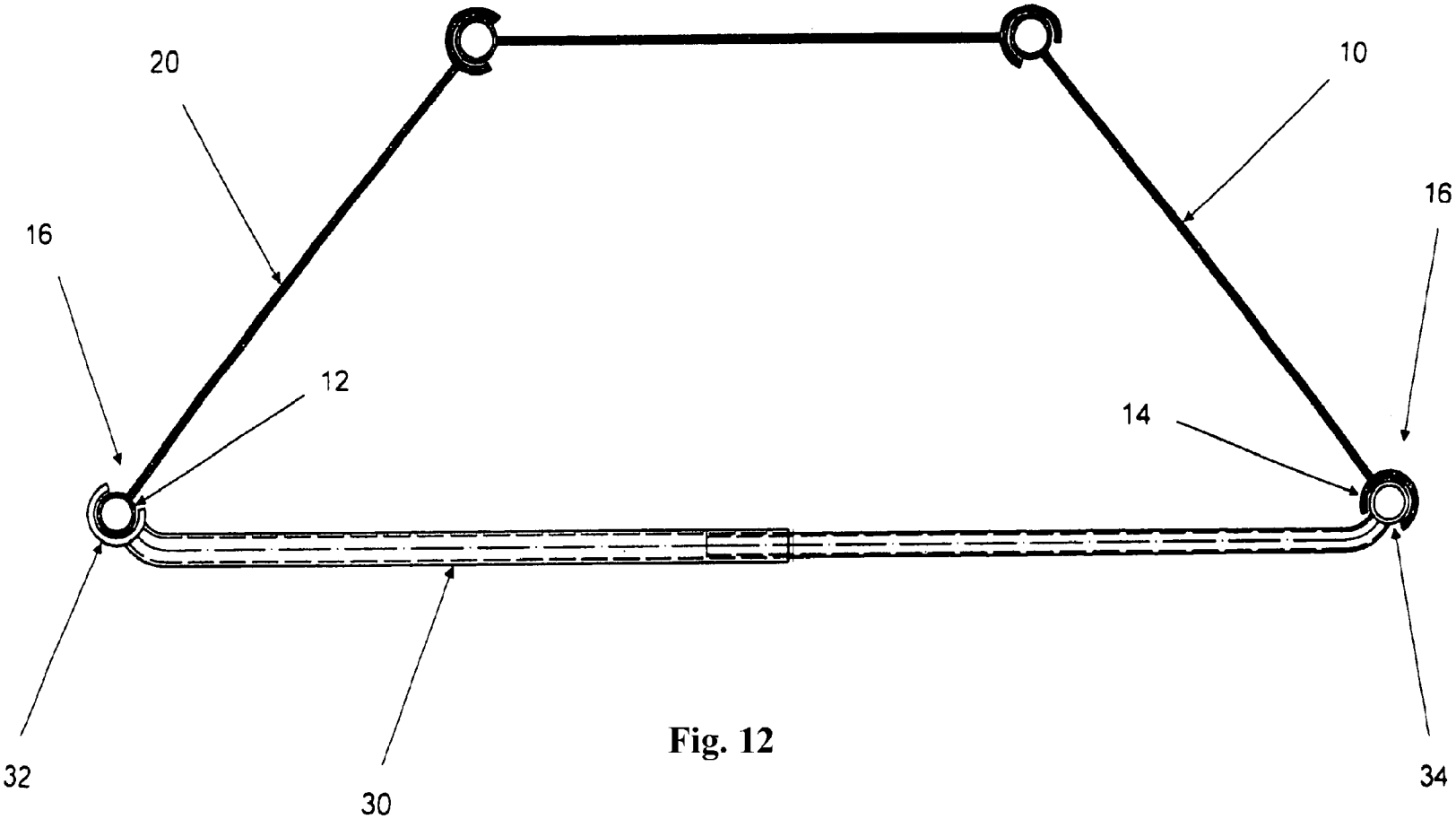
FIG. 12 shows an inventive device in the form of a wall, stabilized by a telescopic pole as described in the invention.

FIG. 12 shows a possible embodiment of an inventive device, in which a telescopic pole 30 is used as a spacer between two wall segments 10, 20 and forms a trunnion joint 16 by means of its circular segment holder 32 and the circular thickening 12 of a wall element 20 and another trunnion joint 16 by means of its circular thickening 34 and the circular segment holder 14 of a wall element 10. In this embodiment, the telescopic pole 30 may either serve as a replacement of a wall element or a stabilizer of a wall according to the invention.

The invention claimed is:

1. A device for protecting living beings and objects from being buried, characterized in that it comprises at least two wall elements interconnected by means of a trunnion joint, both of the wall elements feature a rectangular base body with a first pivot bolt edge in the form of a circular thickening and a second hinged rail edge in the form of a circular segment holder opposing the first edge, and wherein two of the wall elements are each interconnected by means of the trunnion joint formed by the first and second edges of adjacent wall elements in rear grip in such a manner that the wall elements are vertically slideable and horizontally rotatable up to an angle of 60° minimum, wherein at least two of the wall elements are connected to at least one telescopic pole by means of a trunnion joint in such a manner that the at least two wall elements are vertically slideable and horizontally rotatable towards the at least one telescopic pole and each other.

2. The device according to claim 1, wherein the circular segment holder features a gap along the entire length of the second edge.

3. The device according to claims 1, wherein the gap is of an angle of 80° to 150°.

4. The device according to claim 1, wherein the wall elements are constructed of metal or plastic.

5. The device according to claim 1, wherein the wall elements are identical.

6. The device according to claim 1, wherein the device contains four, five or six wall elements.

7. The device according to claim 1, wherein the wall elements form a tube or a wall.

8. The device according to claim 1, wherein the telescopic pole features a circular segment holder and a circular thickening on its ends.

9. The device according to claim 1, wherein the circular segment holder forms an open tube featuring a gap.

10. The device according to claim 1, wherein the circular thickening is a tube.

11. A method for assembling a device according to claim 1, comprising the step (a) connecting the two or more wall elements, wherein each wall element has the first and the opposing second edge, wherein the first edge is a circular thickening and the second edge is a circular segment holder with a gap extending along the entire length of the second edge, by sliding the pivot bolt edge of the wall element through the open end of the hinged rail edge of another wall element along the longitudinal axis of said hinged rail edge into the latter and by thus reversibly connecting the two wall elements in a vertically and horizontally slideable manner, wherein at least one telescopic pole is reversibly connected in a vertically and horizontally slideable manner to at least two wall elements.

12. The method according to claim 11, further comprising the step of adding one or more additional wall elements by repeating step (a).

13. A method for protecting living beings or objects from being buried in bulk material, comprising (a) providing at least two wall elements, wherein each wall element has a first edge and an opposing second edge, wherein the first edge comprises a circular thickening and the second edge comprises a circular segment holder with a gap extending along the entire length of the second edge, (b) interconnecting the at least two wall elements by sliding the first edge within the second edge circular segment holder along the longitudinal axis of the second edge circular segment holder thus reversibly connecting the two wall elements in a vertically and horizontally slideable manner, and (c) placing the at least two interconnected wall elements between the bulk material and the living beings or objects, wherein the at least two wall elements are interconnected in such a manner that they are vertically slideable and horizontally rotatable by means of a telescopic pole.

14. The method according to claim 13, wherein there are provided at least 3 wall elements, and wherein each of the wall elements is interconnected with another wall element at both the first and second edge, thereby forming a fully enclosed wall structure.

* * * * *